US009795531B2

(12) United States Patent
Topcu et al.

(10) Patent No.: US 9,795,531 B2
(45) Date of Patent: Oct. 24, 2017

(54) WEIGHT BALANCING MECHANISM

(71) Applicant: BAMA TEKNOLOJI TIBBI CIHAZLAR DANISMANLIK SAGLIK BILISIM SANAYI VETICARET LIMITED SIRKETI, Ankara (TR)

(72) Inventors: Murat Topcu, Ankara (TR); Akay Ozturk, Ankara (TR); Can Mehmet Ali Ciftci, Ankara (TR)

(73) Assignee: Bama Teknoloji Tibbi Cihazlar Danismanlik Saglik Bilisim Sanayi Veticaret Limited Sirketi, Ankara (TR)

( * ) Notice: Subject to any disclaimer, the term of this patent is extended or adjusted under 35 U.S.C. 154(b) by 0 days.

(21) Appl. No.: 15/033,646

(22) PCT Filed: Oct. 31, 2014

(86) PCT No.: PCT/TR2014/000397
§ 371 (c)(1),
(2) Date: May 1, 2016

(87) PCT Pub. No.: WO2015/065303
PCT Pub. Date: May 7, 2015

(65) Prior Publication Data

US 2016/0296408 A1 Oct. 13, 2016

(30) Foreign Application Priority Data

Nov. 1, 2013 (TR) ..... a 2013 12665

(51) Int. Cl.
*A61H 3/00* (2006.01)
*A63B 69/00* (2006.01)
(Continued)

(52) U.S. Cl.
CPC ..... *A61H 3/008* (2013.01); *A63B 21/00181* (2013.01); *A63B 71/0009* (2013.01);
(Continued)

(58) Field of Classification Search
CPC ..... A61H 3/008; A63B 21/00181; A63B 21/4001; A63B 21/068; A63B 69/0064; A63B 2022/0094; A63B 23/0464
See application file for complete search history.

(56) References Cited

U.S. PATENT DOCUMENTS 4,256,098 A 3/1981 Swan et al.
5,190,507 A 3/1993 Iijima
(Continued)

FOREIGN PATENT DOCUMENTS

CN 102526947 A 7/2012
IN WO9609094 A1 3/1996
(Continued)

*Primary Examiner* — Rachel Young
(74) *Attorney, Agent, or Firm* — Gokalp Bayramoglu

(57) ABSTRACT

This invention is related to a mechanism to be used to balance the weight of a patient or a sportsman in rehabilitation or sport based equipment. The purpose of the weight balancing mechanism subject to the invention is to prevent the legs carry the entire weight of a patient or a sportsman during the walking therapy on a treadmill by carrying a portion of their weight. The other purpose of this invention is to adjust the amount of the weight need to be carried. During the phases of walking due to changing the tension of the rope, no change will be occured in the weight of the user is the final purpose of the invention. In order to reach this aim, a mechanism is developed for adjusting the tension of the rope in the light of the rope movements.

4 Claims, 8 Drawing Sheets

(51) Int. Cl.

| | |
|---|---|
| ***A63B 71/00*** | (2006.01) |
| ***A63B 22/02*** | (2006.01) |
| ***A63B 21/00*** | (2006.01) |
| *A63B 22/00* | (2006.01) |

(52) U.S. Cl.
CPC ..... *A61H 2201/0192* (2013.01); *A63B 22/02* (2013.01); *A63B 22/0235* (2013.01); *A63B 69/0064* (2013.01); *A63B 2022/0094* (2013.01); *A63B 2220/13* (2013.01); *A63B 2230/625* (2013.01)

(56) References Cited

U.S. PATENT DOCUMENTS

| | | | |
|---|---|---|---|
| 2005/0239613 | A1 | 10/2005 | Colombo et al. |
| 2010/0006737 | A1 | 1/2010 | Colombo et al. |

FOREIGN PATENT DOCUMENTS

| | | | |
|---|---|---|---|
| JP | 2004298313 | A | 10/2004 |
| JP | 2007097874 | A | 4/2007 |

WEIGHT BALANCING MECHANISM

TECHNICAL FIELD

This invention is related to a mechanism to be used for balancing the weight of a patient or a sportsman in rehabilitation or sport based equipment.

BACKGROUND

Equipments which are used especially for walking therapy, patients are unable to carry their own weights and for this reason, it is impossible for them to perform their walking exercises. In order to resolve this problem weight balancing and weight systems are used for carrying a portion of the weight of the patient. The main purpose of these systems is to ensure completion of muscle development and coordination of movement in the development of a specific healing process by carrying a portion of the weight instead of the whole weight during walking exercise. During the healing process, it is intented that, as a result of the system carries a portion of the weight, developed muscles can carry the entire body.

Because of the need for adjusting the amount of support during the healing process, various inventions have been developed and patent applications are being made related to this regard in these days. One of them is disclosed in United States patent application US2010006737. in this patent application, a weight support system which is individually adjustable for a variable weight of a patient has been developed by using a double spring and a moment arm.

One of the important feature included in this invention is to remove the negative effects of the patient's natural oscillation movement that occurs during walking. One of these negative effects is that carrying more weight of the patient due to patient's body approaches to the ground in phases of walking and as a. result, the tension will be increased on the springs. In the opposite case, the tension on the springs will be decreased when the patient's body lifts up and it is provided that the less amount of weight is carried by the spring. In order to resolve this natural problem, second spring is added in patent application US2010006737. (patent application US2010006737 50. Mean) and moment arm is added in patent application US2010006737 (41. Mean).

The similar prior art of this regard is the patent application US2005239613again applied in the U.S. In this application it is disclosed that to be adjusted the amount of the rope to be released in weight balancing system by using two motors and also the tension values are controlled by said motors.

SUMMARY OF THE INVENTION

The purpose of the weight balancing mechanism subject to the invention is to prevent the legs of a patient or a sportsman from carving the entire weight during the walking therapy on a treadmill by carrying a portion of their weight. The other purpose of this invention is to adjust the amount of the weight which is need to be carried.

The final aim of the present invention is that during the phases of walking owing to changing the tension of the rope, no change will be occured in the weight of the user to be carried. In order to reach this aim, a mechanism is developed for adjusting the tension of the rope in accordance with the rope movements.

BRIEF DESCRIPTION OF DRAWINGS

A weight balancing mechanism subject to the invention is shown in the attached figures and according to the said figures.

Figure 1:
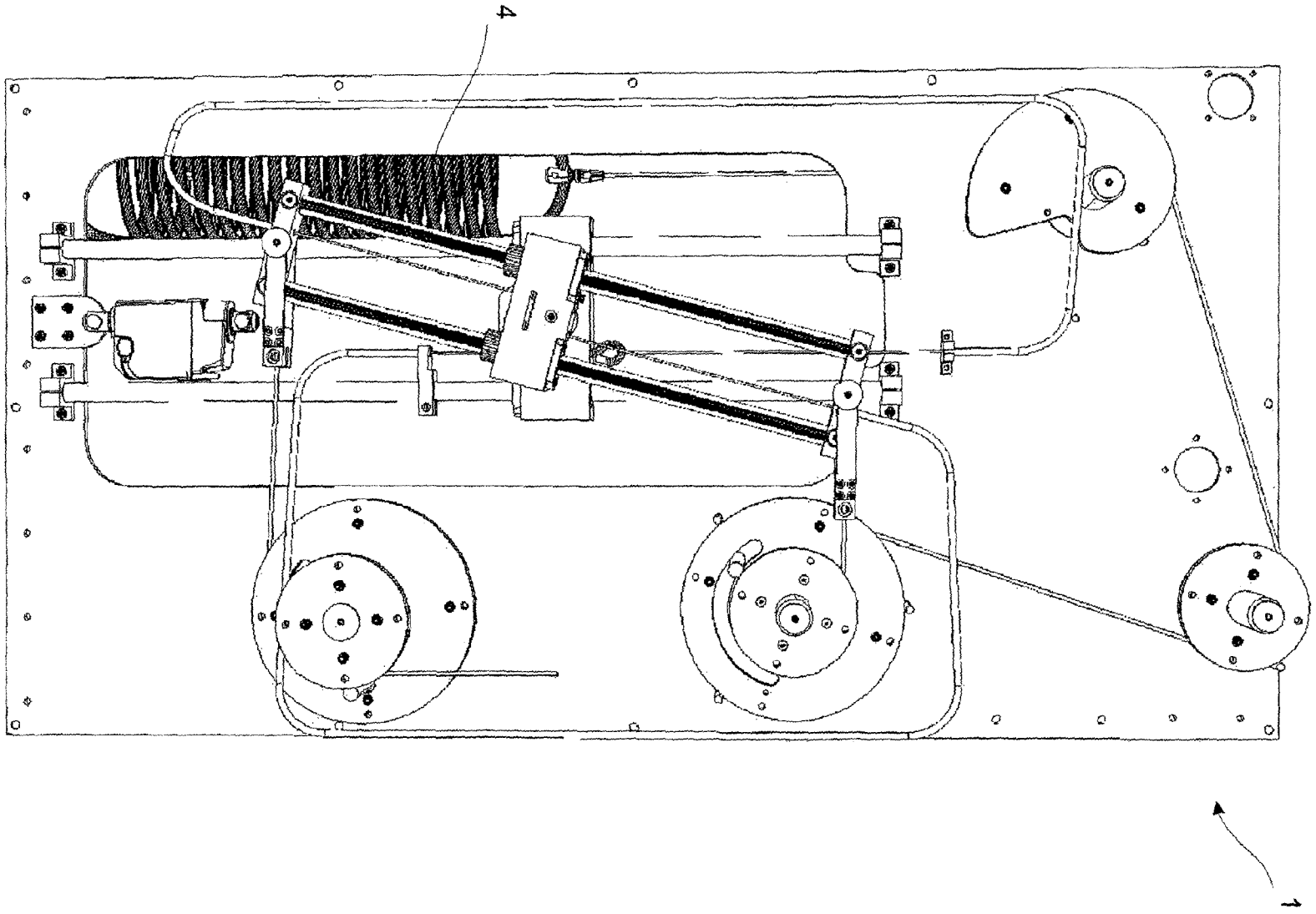
FIG. 1—Is the front perspective view of a weight balancing mechanism subject to the invention.
Figure 2:
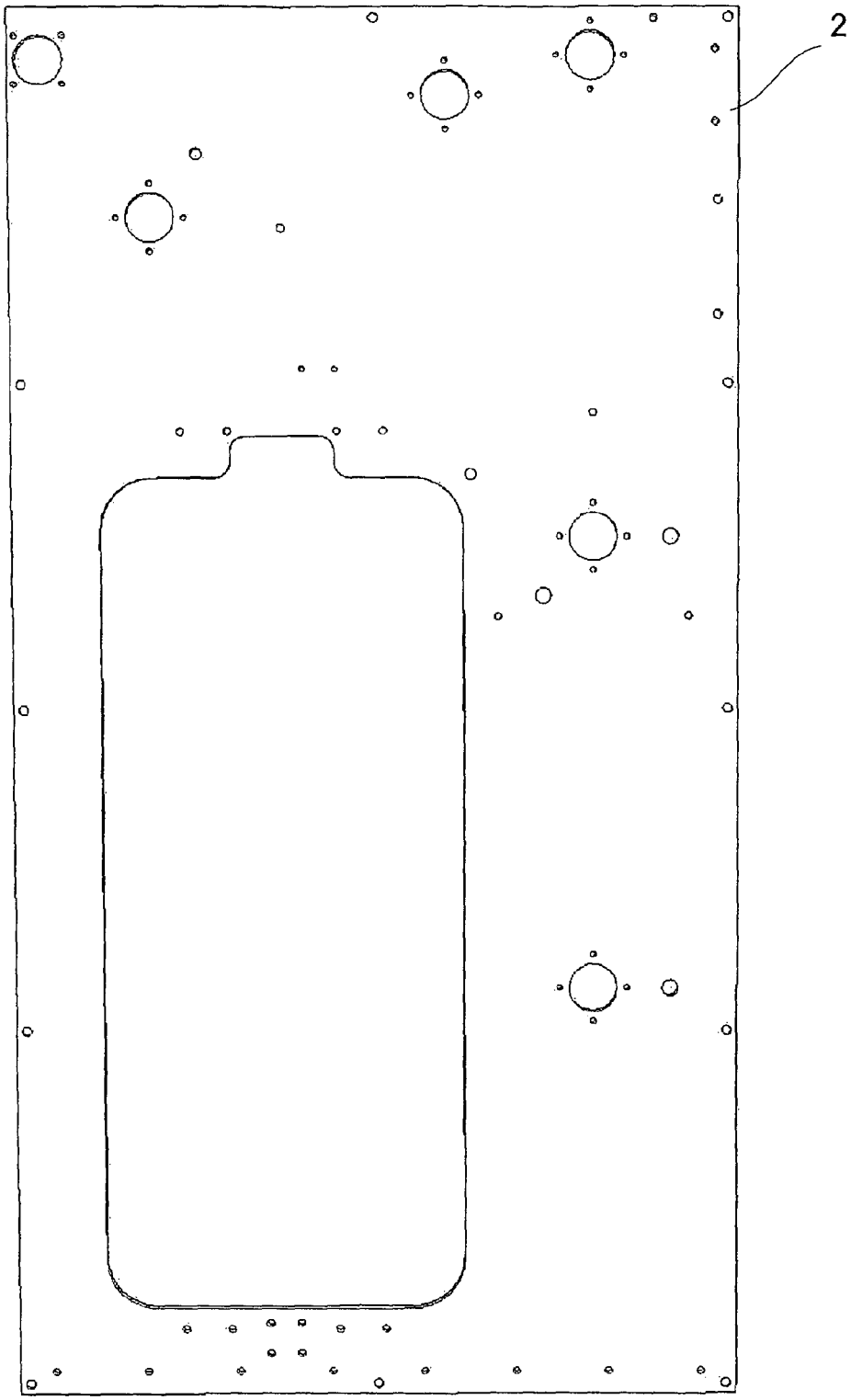
FIG. 2—Is the front perspective view of the body of the weight balancing mechanism subject to the invention.
Figure 3:
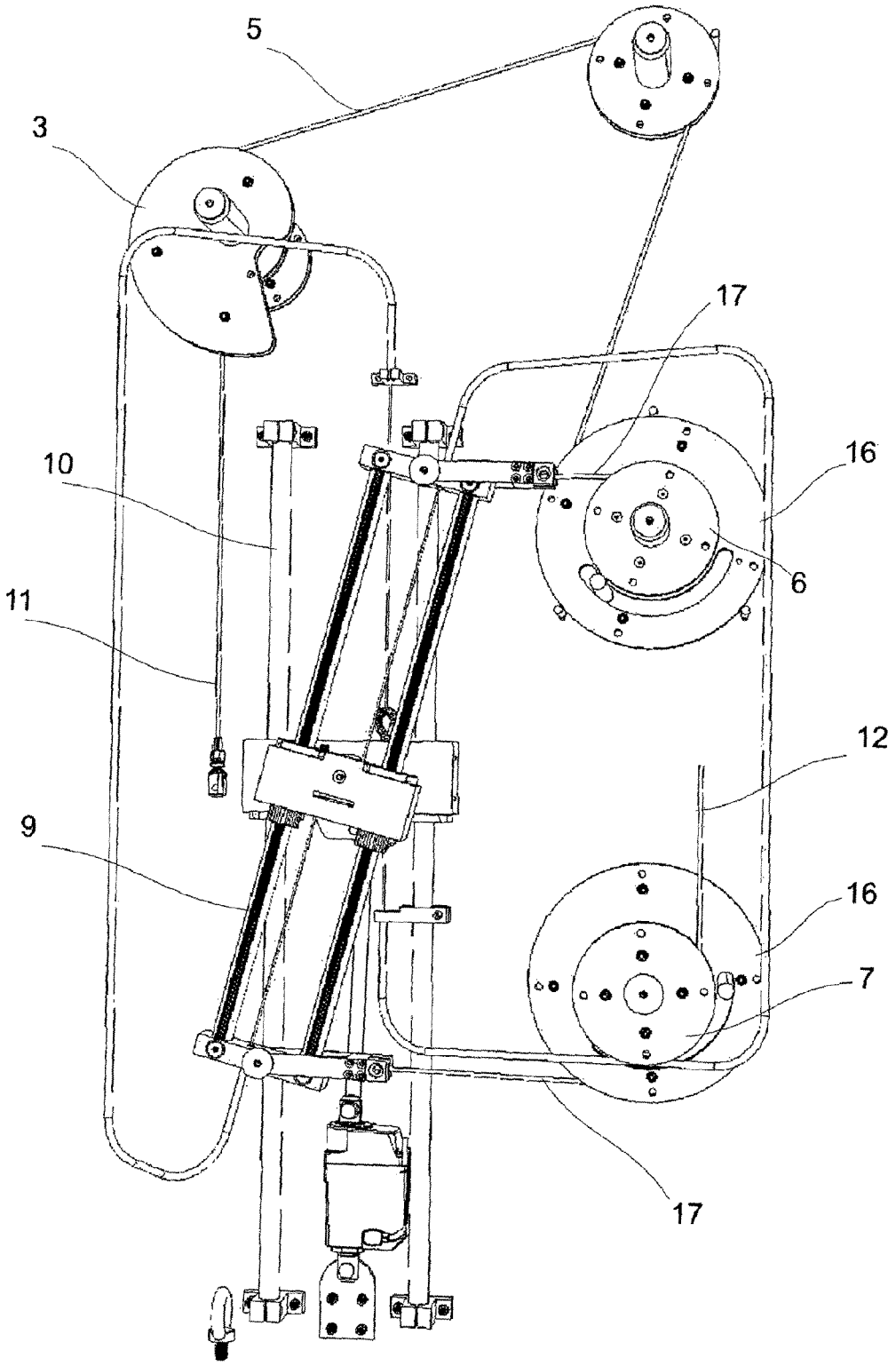
FIG. 3—Is the front perspective view of a weight balancing mechanism without a body and spring.
Figure 4:
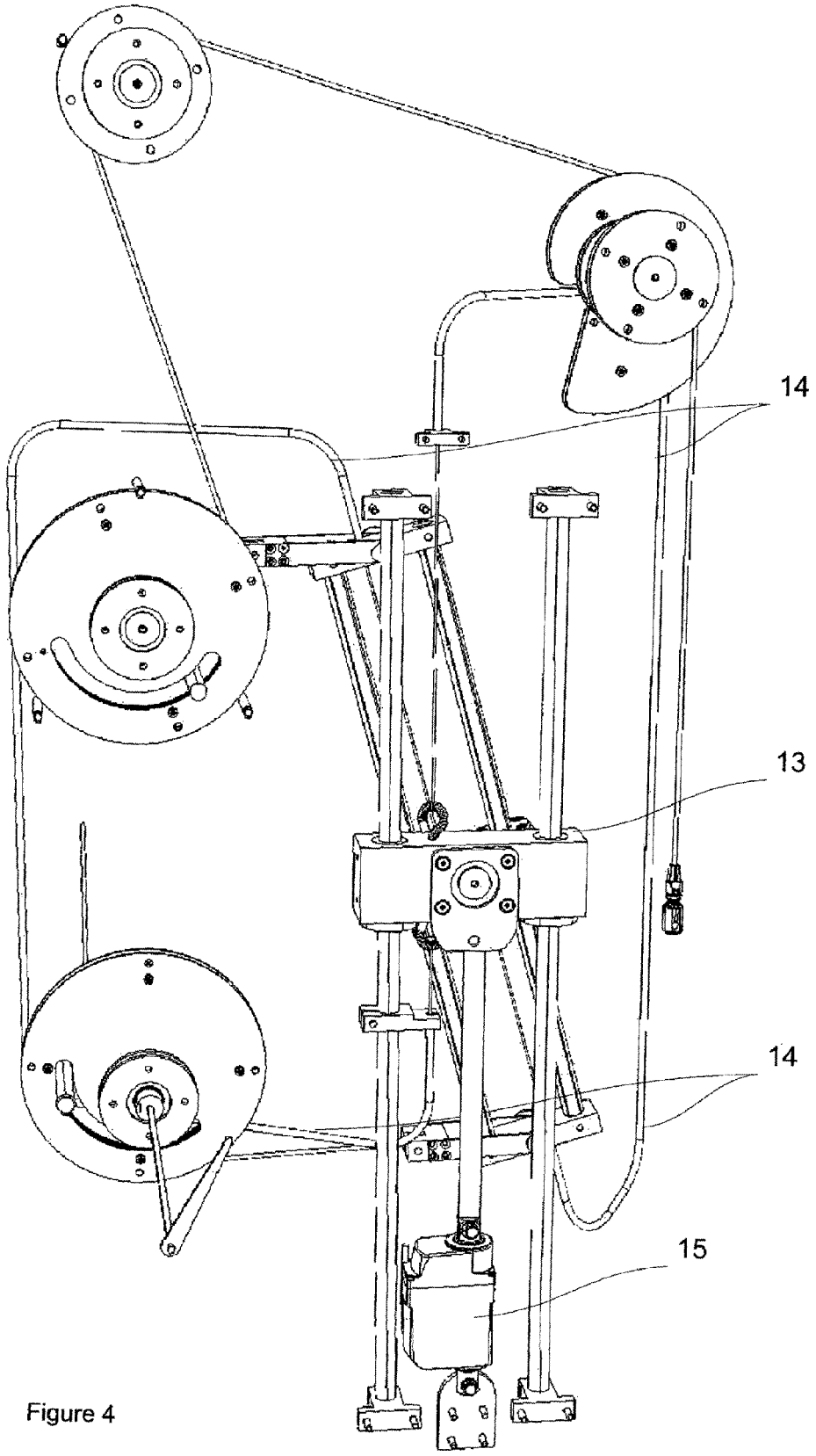
FIG. 4—Is the posterior perspective view of a weight balancing mechanism subject to the invention.

The means of the figures are numbered and the definitions of said numbers are given following;

18. Mechanism
19. Body
20. Cam
21. Spring
22. Cam wire
23. Spring reel
24. Load reel
25. Moment arm group
26. Double movable Shaft
27. Fixed shaft
28. Spring wire
29. Load wire
30. Bearing
31. Brake Wire
32. Motor
33. Rope reel
34. Rope
F0. Load amount
F. Applied force
Lp. Moment arm length
L. Movable double shaft length
A. A angle
θ Teta angle

DETAILED DESCRIPTION OF THE INVENTION

A weight balancing mechanism (1) subject to the invention, the most basic form comprises a spring (4), a cam (3) a cam wire (5), a spring reel (6) a load reel (7) and a moment arm group (8). All of these components are mounted on a body (2) formed as a rectangle, are moving on their location connected angular or linear.

Spring (4) moves the cam (3) angularly by stretching with the spring wire (11) in order to take the weight to be balanced from the person. Cam (3) will be carrying the load of the spring (3) by pulling and releasing the cam wire (5) with a rotational movement. Cam (3), owing to it's own spiral form, pulls or releases the cam wire (5) at different amounts of defined teta angle (θ). This movement of the cam (3) is the first process to balance the high or low tension made by the spring (4) during the up-down oscillation movements occured by the person during walking. However, said amount of balancing provides a rough balancing, in case of the weight of the patient increases or the spring (4) remains under a heavier load, the adjustments made by the cam (3) will not work. For this reason, a moment arm group (8) is added to the cam (3) for enabling an accurate balancing.

Figure 5:
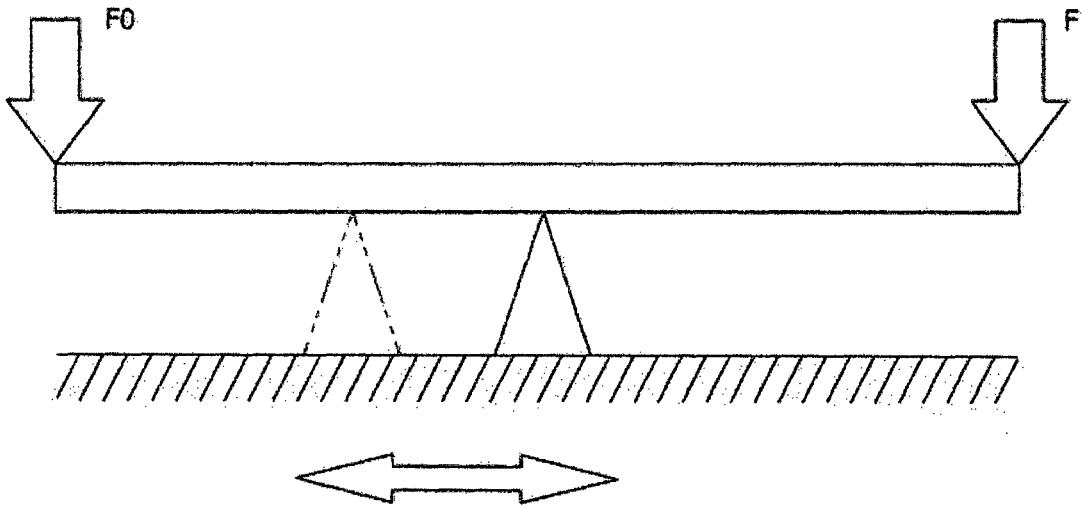
FIG. 5—Is the shematic illustration showing the moment arm modified by the action of the bearing on a crane mechanism.
Figure 6:
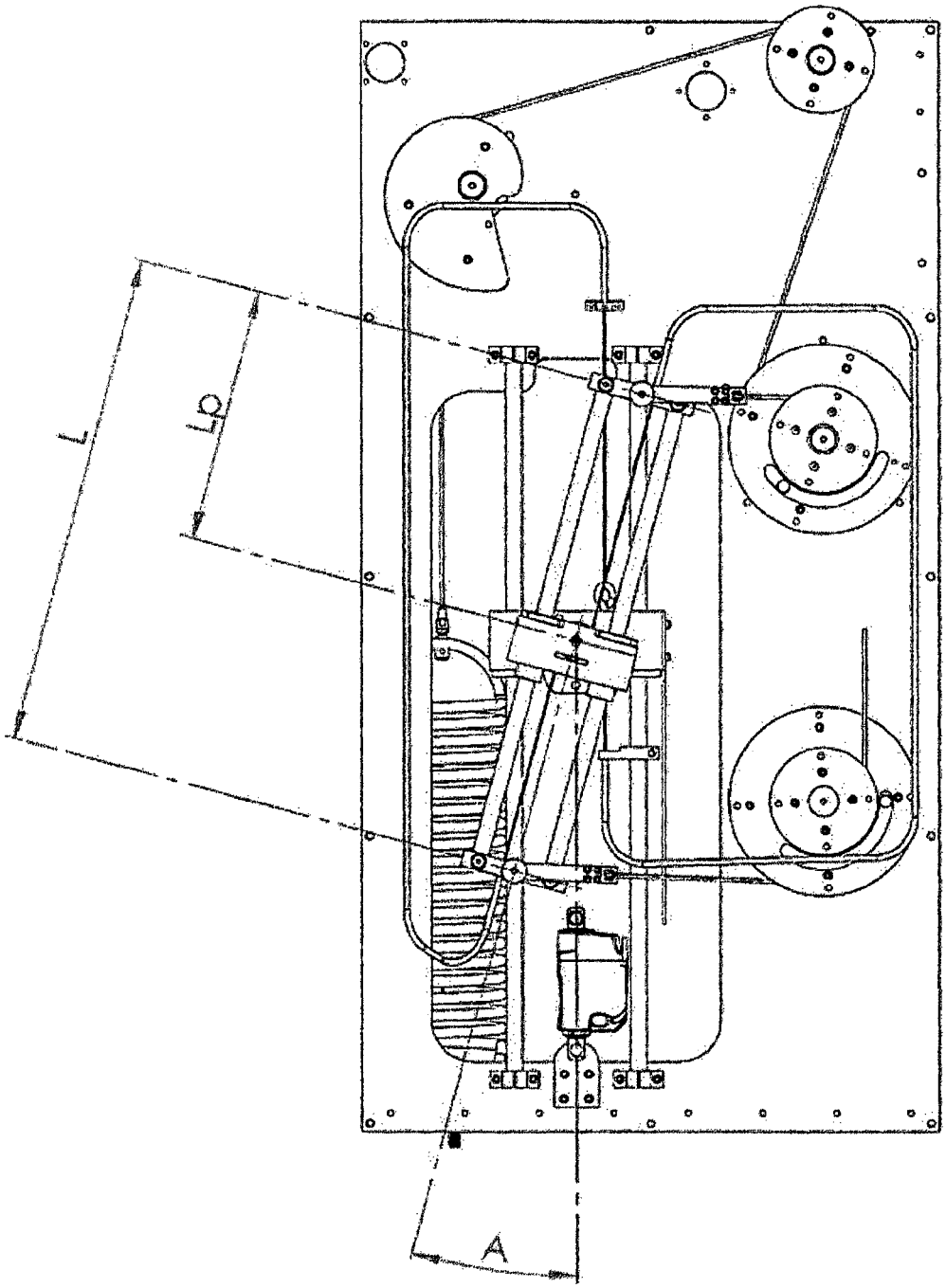
FIG. 6—Is the side view of moment arm group of a weigth balancing mechanism subject to the invention showing the measuring point of the variant Lp arm length.
Figure 7:
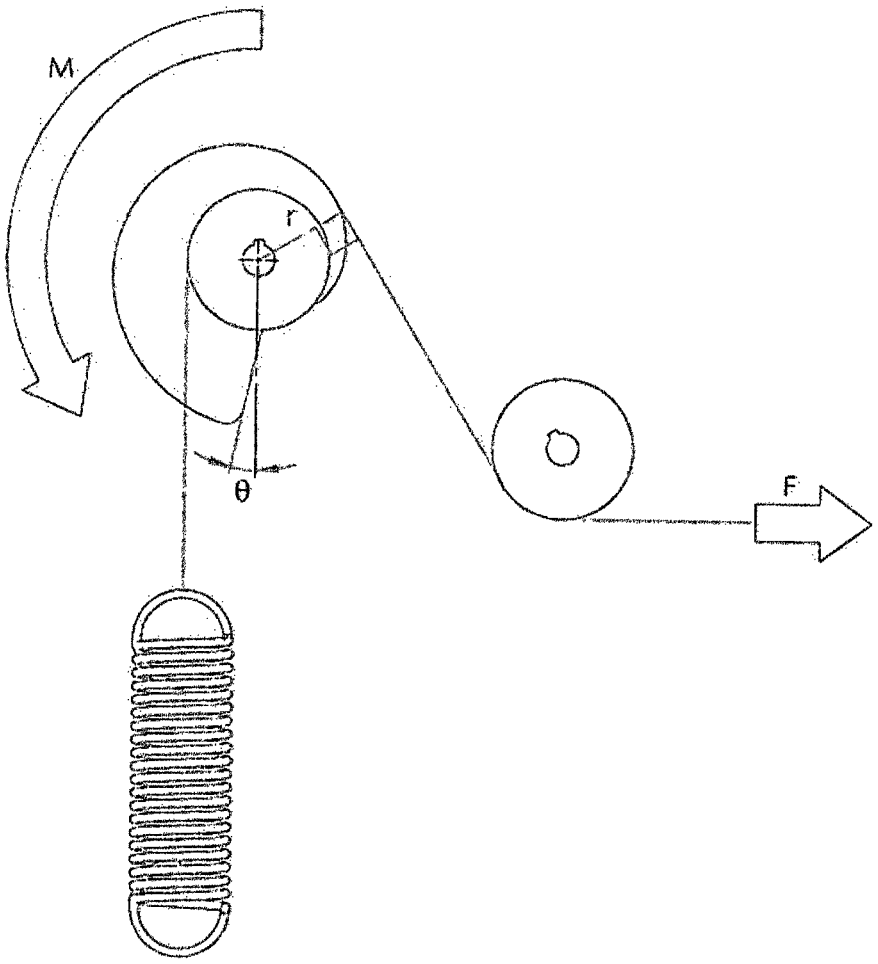
FIG. 7—Is the side view of the cam and spring components of a weight balancing mechanism subject to the invention.
Figure 8:
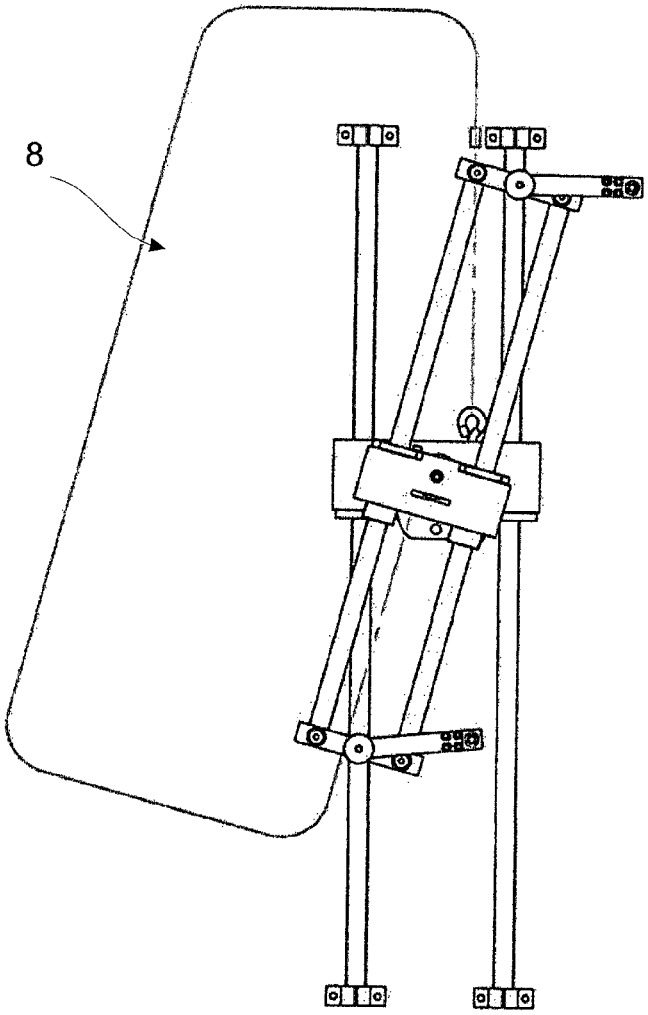
FIG. 8—Is the side view of the wire which moves up the movable block on the blance arm of a weight weight balancing mechanism subject to the invention.
Figure 9:
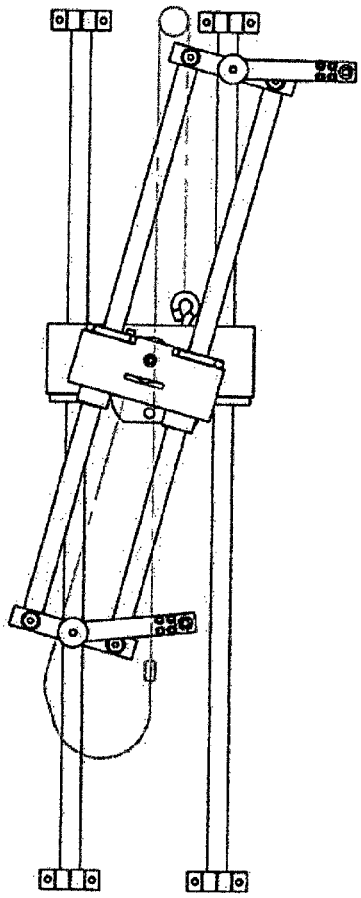
FIG. 9—Is the side view of the wire the wire which moves up the movable block on the blance arm of a weight weight balancing mechanism subject to the invention in a different configuration.

A moment arm group (8) works as a crane described in FIG. 5. In case of the bearing (13) point is in the middle of two moment arms, applied force (F) and load force (F0) will be equal and the system will be balanced. If the bearing arm (13) is driven on the direction of load force (F0) of the bearing arm (13), the system will be balanced in case of the applied force (F) is lower than the load amount (F0). By using this basic mechanical effect, the amount of the load taken away from the patient by the movements of moment arm group (8) is ought to be equal even in the different spring (4) positions.

The forces on the moment arm group (8) is transferred by two rope reels (16) with ropes (17). The first of these reels is the spring reel (6) which is attached to the cam wire (5). As a result of the spring (4) opens and leaves the spring wire (11), spring reel (6) turns around and provides the expansion of A angle (A), so that the double movable shall (9) moves away from the vertical axis to the ground. As the double movable shaft (9) moves away from the vertical axis to the ground, the load wire (12) of the load reel (7) will be collected. The ropes (17) are attached to the movable double shaft (9) which moves around the bearing (13). As one of them pulls it's rope (17) the other one releases it's rope (17). The force is being transferred to the other side in accordance with the position of the bearing (13) on the movable double shaft (9).

If the position of the bearing (13) which is attached to the moment arm group (8) doesn't change, as another words, unless the moment arm length (Lp) is adjusted to the desired length, the force which is transferred by the spring (4) will be transferred to patient without being corrected. Therefore, in order to make the correction, the position of the bearing (13) ought be changed. The bearing (13) is disposed such that it can move over another double shaft in order to prevent the horizontal position levels of the movable double shaft (9) ends from moving away at the same amount of length from the horizontal levels of the spring reel (6) and load reel (7). This is the fixed double shaft (10) and positioned vertical to the ground.

The bearing position (13) is changed by a motor (15) which drives the bearing (13) over the fixed shaft (10). Changing the arm lengths in the crane movement which occurs by the movable double shaft (9) along the bearing (13) as the bearing position (13) is changed, is the aim of the fixed double shaft (10).

Driving the movable bearing, (13) over the fixed shaft (10) is not enough to ensure the change of the arm length described above. However, during the bearing is being moved over the movable double shaft (9) co-ordinated, the moment arm length (Lp) on the movable double shaft length (L) can be changed. For the explained co-ordinated movement, the brake wires (14) will be useful.

The ends of the covers of the brake wires (14) are attached on the body (2) in order to move the bearing (13), able to move the bearing (13) in two way by pulling these wires (14) up or down. During that movements, the ends of the covers of the brake wires (14) which are not attached on the body (2), are mounted on the movable double shaft (9) ends. Yet again these wires (14) explained above, can move the bearing (13) in two ways. During the bearing (13) is being moved either on the fixed shaft (10) or movable double shaft (9), the wires (14) transport their tension and flexibility crossly to eachother. After the bearing (13) is moved up by the motor (15) the down wire (14) of the movable double shaft (9) will be stretched and at the same time, the tension will enable the bearing (13) to move downward on the fixed double shaft (10) as the wire on the fixed double shaft (10) releases. The similar situation will be valid for other wire connections.

Beyond the cam (3) provides the coarse adjustment, in order to make the fine adjustments the force which is transfered from the spring (4) to the load wire (12) will be adjusted after the bearing (13) is driven over the fixed double shaft (10) by motor (15) or by an alternative movement source which is able to move the bearing (13) linearly.

In addition to this, for enabling the movements described above, the bearing (13) itself comprises two bodies (2) which the movable double shaft (9) and fixed double shaft (10) are mounted on and a connection point which enables the bodies (2) to stay together and rotate relative to eachother.

The elements which are described above as movable double shaft (9) and fixed double shaft (10) are used for enabling the bearing (13) move in a defined axis without rotating around itself. Whereas, various sliding systems instead of movable double shaft (9) and fixed double shaft (10) can be used in the present invention.

In the above embodiment of the invention cam (3) and the cam wire (5) are described in some situations wherein a coarse adjustment isn't needed, instead of all of these, the spring wire (11) can possibly be attached directly to the spring reel (6).

The invention claimed is:

1. A weight balancing mechanism for balancing the weight of a patient in a rehabilitation equipment, comprising:

a spring, where the weight of the patient to be balanced is transferred from a spring wire to the spring;

a plurality of rope reels configured to transfer a force between a spring reel, wherein the spring wire is attached on the spring reel and a load reel, wherein a load wire is attached on the load reel;

a moment arm group comprising a movable double shaft, a fixed double shaft and a bearing;

a first rope connecting a first end of the movable double shaft to the spring real; and a second rope connecting a second end of the movable double shaft to the load real;

wherein the movable double shaft transfers the force to the spring reel through the first rope and the load reel through the second rope;

wherein the bearing includes a first block engaged to the fixed double shaft, and a second block engaged to the movable double shaft;

wherein the first block is configured to slide along the fixed double shaft in a vertical direction;

wherein the second block is configured to slide along movable double shaft and the second block is pivotly connected to the first block;

wherein the bearing provides a transfer of the force to a side opposite to a direction of the relative position of the bearing from the center of the movable double shaft along the length of the movable shaft.

2. The weight balancing mechanism of claim 1, wherein a plurality of brake wires attached to the bearing for providing a co-ordinated movement over the movable double shaft and the fixed double shaft and drives the bearing on the movable double shaft.

3. The weight balancing mechanism of claim 1, wherein a spiral formed cam, wherein the spiral formed cam pulls and releases the spring wire at the same time being moved circularly by a cam wire in order for a power transferred to the spring to be variable.

4. The weight balancing mechanism of claim 2, wherein a spiral formed cam, wherein the spiral formed cam pulls and releases the spring wire at the same time being moved circularly by a cam wire in order for a power transferred to the spring to be variable.

* * * * *